US010309395B2

(12) United States Patent
Ramier et al.

(10) Patent No.: US 10,309,395 B2
(45) Date of Patent: Jun. 4, 2019

(54) METHOD AND APPARATUS TO MANUFACTURE A PROGRESSIVE CAVITY MOTOR OR PUMP

(71) Applicant: Smith International, Inc., Houston, TX (US)

(72) Inventors: Julien Ramier, Cambridge (GB); Peter Cariveau, Houston, TX (US); Pierre Lauric Dubesset, Katy, TX (US)

(73) Assignee: SMITH INTERNATIONAL, INC., Houston, TX (US)

( * ) Notice: Subject to any disclaimer, the term of this patent is extended or adjusted under 35 U.S.C. 154(b) by 32 days.

(21) Appl. No.: 14/772,925

(22) PCT Filed: Mar. 4, 2014

(86) PCT No.: PCT/US2014/020325
§ 371 (c)(1),
(2) Date: Sep. 4, 2015

(87) PCT Pub. No.: WO2014/138068
PCT Pub. Date: Sep. 12, 2014

(65) Prior Publication Data

US 2016/0186747 A1 Jun. 30, 2016

Related U.S. Application Data

(60) Provisional application No. 61/773,072, filed on Mar. 5, 2013.

(51) Int. Cl.
*F01C 1/10* (2006.01)
*F03C 2/00* (2006.01)
(Continued)

(52) U.S. Cl.
CPC ..... *F04C 2/1071* (2013.01); *E21B 4/02* (2013.01); *F03B 13/02* (2013.01); *F04B 47/00* (2013.01);
(Continued)

(58) Field of Classification Search
CPC .... F04C 2/1071; F04C 2/1073; F04C 2/1075; F04C 5/00; F04C 15/0076; F04C 2240/10;
(Continued)

(56) References Cited

U.S. PATENT DOCUMENTS 3,354,537 A * 11/1967 O'Connor ..... F04C 2/1071 418/48
3,912,426 A * 10/1975 Tschirky ..... F04C 2/1071 418/48
(Continued)

FOREIGN PATENT DOCUMENTS

DE 19801020 A1 7/1999
WO 2014138068 A1 9/2014

OTHER PUBLICATIONS

International Search Report for International Application No. PCT/US2014/020325 dated Jun. 3, 2014.
(Continued)

*Primary Examiner* — Theresa Trieu

(57) ABSTRACT

A stator and a method of manufacturing at least a portion of a progressive cavity motor or pump include disposing a cylindrical shell within a cylindrical housing, disposing a stator mold within the cylindrical shell, disposing an elastomeric material between the stator mold and the cylindrical shell, removing the stator mold from within the elastomeric material, thereby forming an elastomeric material layer having a stator profile within the cylindrical shell, and removing the cylindrical shell from within the cylindrical
(Continued)

housing, thereby forming a cartridge having the elastomeric material layer disposed within the cylindrical shell.

23 Claims, 5 Drawing Sheets

(51) Int. Cl.

| | |
|---|---|
| ***F03C 4/00*** | (2006.01) |
| ***F04C 2/00*** | (2006.01) |
| ***F04C 2/107*** | (2006.01) |
| ***E21B 4/02*** | (2006.01) |
| ***F03B 13/02*** | (2006.01) |
| ***F04B 47/00*** | (2006.01) |
| ***F04C 15/00*** | (2006.01) |

(52) U.S. Cl.
CPC ..... *F04C 2/1075* (2013.01); *F04C 15/00* (2013.01); *F04C 2230/101* (2013.01); *F04C 2230/103* (2013.01); *F04C 2230/21* (2013.01); *F04C 2230/23* (2013.01)

(58) Field of Classification Search
CPC ..... F04C 2230/00; F04C 2230/101; F04C 2230/103; F04C 2230/26; F04C 2230/40; F04C 2230/90; F04C 2230/91; F04C 2230/92; F04C 15/00; F01C 1/101; F05C 2225/00; F05C 2225/04; E21B 4/02; F03B 13/02; F04B 47/00
USPC ..... 418/1, 48, 152, 153, 178–179; 29/888.023, 888.061
See application file for complete search history.

(56) References Cited

U.S. PATENT DOCUMENTS

| | | | | |
|---|---|---|---|---|
| 4,207,037 | A | 6/1980 | Riordan | |
| 4,991,292 | A * | 2/1991 | Bostel | F04C 2/1075 29/888.023 |
| 5,846,665 | A * | 12/1998 | Timmer | C23C 28/00 428/626 |
| 6,158,988 | A * | 12/2000 | Jager | F04C 2/1071 418/48 |
| 6,973,707 | B2 * | 12/2005 | McKay | F04C 2/1075 29/888.023 |
| 7,192,260 | B2 * | 3/2007 | Lievestro | F04C 2/1071 418/48 |
| 7,905,714 | B2 * | 3/2011 | Gerling | F04C 2/1071 418/48 |
| 2005/0106004 | A1 | 5/2005 | Jager | |
| 2006/0029507 | A1 | 2/2006 | Kaiser et al. | |
| 2008/0304992 | A1 | 12/2008 | Hooper et al. | |
| 2010/0284843 | A1 | 11/2010 | Jager | |
| 2011/0116961 | A1 | 5/2011 | Akbari et al. | |
| 2012/0216401 | A1 | 5/2012 | Robisson et al. | |
| 2013/0056443 | A1 | 3/2013 | Ramier et al. | |

OTHER PUBLICATIONS

International Preliminary Report on Patentability issued in International Patent application PCT/US2014/020325, dated Sep. 8, 2015. 7 pages.
Search and Examination Report R 62 EPC issued in European Patent Application 14760199.1 on Sep. 26, 2016. 9 pages.

* cited by examiner

METHOD AND APPARATUS TO MANUFACTURE A PROGRESSIVE CAVITY MOTOR OR PUMP

BACKGROUND

Downhole motor assemblies, such as mud motors, are used to supplement drilling operations by turning fluid power into mechanical torque and applying this torque to a drill bit. The drilling fluid or drilling mud is used to cool and lubricate the drill bit, carry away drilling debris, and provide a mud cake on the walls of the annulus to prevent the hole from sloughing in upon itself or from caving in all together.

One example of a drilling assembly using a mud motor is illustrated in FIGS. 1 and 2. In FIGS. 1 and 2, the downhole assembly includes a motor 11 that is suspended on a string of tubing in the well. The motor 11 is of a progressive cavity type, and has a tubular housing 15 that contains an elastomeric stator 17. The stator 17 is a stationary elastomeric member having cavities 19 throughout its length. A rotor 21 extends through the cavities 19, and rotates as a fluid is passed through the motor 11.

The downhole assembly has a longitudinal axis 35 that coincides with the longitudinal axis of the motor 11. The rotor 21 will orbit eccentrically relative to the axis 35, as indicated by the numeral 37. The amount of lateral deviation from the axis 35 may be on the order of about 3.1 mm to about 6.4 mm (about ⅛ to ¼ inch), for example. The rotor 21 is connected to a connector shaft 39 by a rotor coupling 41. The rotor coupling 41 forms a rigid connection that causes the upper end of the connector shaft 39 to orbit in unison with the lower end of rotor 21. The lower end of the connector shaft 39 connects to a drive shaft coupling 43, which is also a rigid coupling. The drive shaft coupling 43 rotates concentrically on the longitudinal axis 35. The connector shaft 39 will flex along its length because of the orbiting movement of its upper end. The drive shaft coupling 43 is then connected via a drive shaft 45, directly or indirectly, to the drill bit.

In operation, the motor assembly will be assembled and lowered into a well on a string of tubing. Once in place, drilling mud is supplied to the motor 11, causing the rotor 21 to rotate eccentrically. This causes the connector shaft 39 to rotate, which in turn rotates the drive shaft 45 and the drill bit (not shown) connected thereto. The motor 11 will discharge the fluid out the lower end and thence to the drill bit for cooling of the drill bit and removal of drill cuttings, where it flows to the surface. Because of the severe operating and environmental conditions associated with oilfield applications, mud motors may fail due to insufficient adhesion or bonding between materials forming the components of the mud motors.

SUMMARY

In one aspect, embodiments disclosed herein relate to a method of manufacturing at least a portion of a progressive cavity motor or pump. The method includes disposing a cylindrical shell within a cylindrical housing, disposing a stator mold within the cylindrical shell, disposing an elastomeric material between the stator mold and the cylindrical shell, removing the stator mold from within the elastomeric material, thereby forming an elastomeric material layer having a stator profile within the cylindrical shell, and removing the cylindrical shell from within the cylindrical housing, thereby forming a cartridge having the elastomeric material layer disposed within the cylindrical shell.

In another aspect, embodiments disclosed herein relate to a stator that includes a stator housing, a cylindrical shell disposed within the stator housing, and an elastomeric material layer disposed within the cylindrical shell, the elastomeric material layer defining a stator profile within the cylindrical shell.

In another aspect, embodiments disclosed herein relate to a method of manufacturing at least a portion of a progressive cavity motor or pump. The method includes treating an inner surface of a cylindrical shell to facilitate adhering an elastomeric material to the cylindrical shell, thereby forming an adhesive treatment layer on the inner surface of the cylindrical shell, disposing the cylindrical shell within a cylindrical housing, disposing a stator mold within the cylindrical shell, injecting the elastomeric material between the stator mold and the cylindrical shell, curing the elastomeric material, adhering the elastomeric material to the cylindrical shell, removing the stator mold from within the elastomeric material, thereby forming an elastomeric material layer having a stator profile within the cylindrical shell, removing the cylindrical shell from within the cylindrical housing, thereby forming a cartridge having the elastomeric material layer disposed within the cylindrical shell, disposing an adhesive material comprising a metal-to-metal bonding agent within the stator housing, thereby forming an adhesive layer within the stator housing, and adhering the cartridge within the stator housing.

This summary is provided to introduce a selection of concepts that are further described below in the detailed description. This summary is not intended to identify key or essential features of the claimed subject matter, nor is it intended to be used as an aid in limiting the scope of the claimed subject matter.

DETAILED DESCRIPTION

Figure 1:
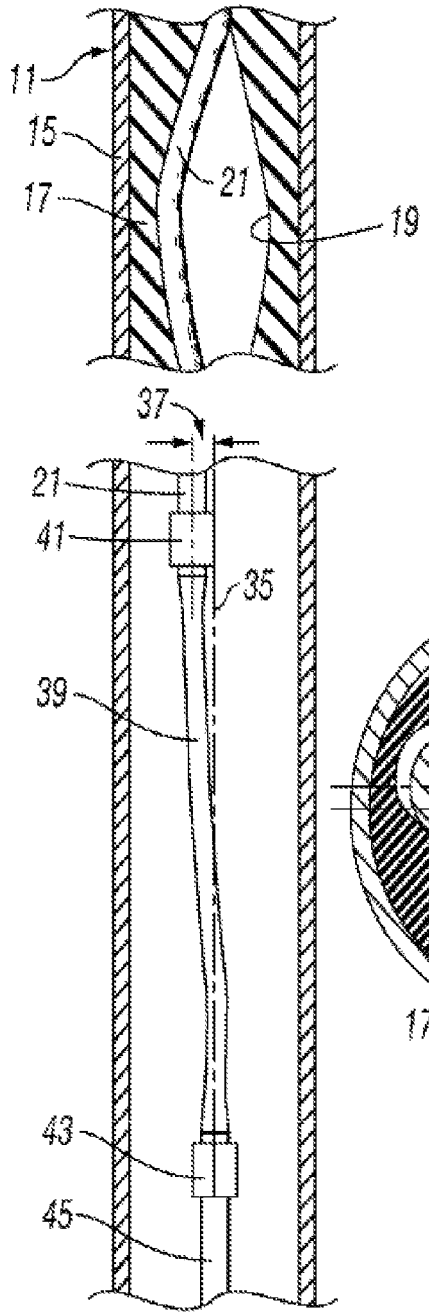
FIG. 1 PRIOR ART
FIG. 1 shows an internal view along a length of a progressive cavity mud motor.

Specific embodiments will now be described in detail with reference to the accompanying Figures. Like elements in the various figures may be denoted by like reference numerals for consistency. Further, in the following detailed description, numerous specific details are set forth in order to provide a more thorough understanding of the disclosed embodiments. However, it will be apparent to one of ordinary skill in the art that the embodiments disclosed herein may be practiced without these specific details. In other instances, well-known features have not been described in detail to avoid unnecessarily complicating the description.

In the following discussion and in the claims, the terms "including" and "comprising" are used in an open-ended fashion, and thus should be interpreted to mean "including, but not limited to . . . " Further, the terms "axial" and "axially" generally mean along or parallel to a central or longitudinal axis, while the terms "radial" and "radially" generally mean perpendicular to a central longitudinal axis. Additionally, directional terms, such as "above," "below," "upper," "lower," "horizontal," "vertical," "top," "bottom," etc., are used for convenience in referring to the accompanying drawings, and the terms are not meant to limit the disclosure.

Furthermore, those having ordinary skill in the art will appreciate that when describing connecting or coupling a first element to a second element, it is understood that connecting or coupling may be either directly connecting or coupling the first element to the second element, or indirectly connecting or coupling the first element to the second element. For example, a first element may be directly connected or coupled to a second element, such as by having the first element and the second element in direct contact with each other, or a first element may be indirectly connected or coupled to a second element, such as by having a third element, and/or additional elements, connected or coupled between the first and second elements.

Embodiments disclosed herein relate to at least a portion of a progressive cavity motor or pump, and methods of manufacturing at least a portion of a progressive cavity motor or pump. An embodiment in accordance with the present disclosure may include a stator having a stator housing, a cylindrical shell disposed within the stator housing, and an elastomeric material layer disposed within the cylindrical shell, in which the elastomeric material layer defines a stator profile within the cylindrical shell. The stator may also include an adhesive layer between the cylindrical shell and the stator housing, in which the adhesive layer may include a metal-to-metal bonding agent. Further, the cylindrical shell may include a treatment on an inner surface thereof, thereby forming an adhesive treatment layer on the inner surface of the cylindrical shell, to facilitate adhering the elastomeric material layer to the cylindrical shell. The treatment on the inner surface of the cylindrical shell may include a mechanical treatment and/or a chemical treatment, in which the mechanical treatment may include a thermal spray treatment, a laser beam treatment, a plasma coating treatment, and/or a machining treatment, and the chemical treatment may include an etching treatment and/or a primer and adhesive treatment.

Further, an embodiment in accordance with the present disclosure may include disposing a cylindrical shell within a cylindrical housing, disposing a stator mold within the cylindrical shell, disposing an elastomeric material between the stator mold and the cylindrical shell, removing the stator mold from within the elastomeric material, thereby forming an elastomeric material layer having a stator profile within the cylindrical shell, and removing the cylindrical shell from within the cylindrical housing, thereby forming a cartridge having the elastomeric material layer disposed within the cylindrical shell. The method may further include disposing the cartridge within a stator housing, thereby forming a stator of the progressive cavity motor or pump.

Disposing the cartridge within the stator housing may include disposing an adhesive material within the stator housing, thereby forming an adhesive layer within the stator housing, and adhering the cartridge within the stator housing. Further, disposing the elastomeric material between the stator mold and the cylindrical shell may include injecting the elastomeric material between the stator mold and the cylindrical shell, curing the elastomeric material, and adhering the elastomeric material to the cylindrical shell. The method may further include treating an inner surface of the cylindrical shell to facilitate the adhering the elastomeric material to the cylindrical shell, thereby forming an adhesive treatment layer between the elastomeric material layer and the cylindrical shell.

Referring now to FIGS. 3-9, multiple perspective views of a method and apparatus to form and/or manufacture at least a portion of a progressive cavity motor or pump in accordance with one or more embodiments of the present disclosure are shown. As such, referring initially to FIG. 3, a perspective view of a cylindrical shell 310 in accordance with one or more embodiments of the present disclosure is shown. The cylindrical shell 310 may be formed from and/or include metal, such as stainless steel, or any steel known in the art. An elastomeric material may be used to adhere to an inner surface 312 of the cylindrical shell 310. As such, a treatment, such as a mechanical treatment and/or a chemical treatment, may be applied to the inner surface 312 of the cylindrical shell 310, thereby forming an adhesive treatment layer thereon, to facilitate adhering the elastomeric material to inner surface 312 of the cylindrical shell 310.

As mentioned, the treatment on the inner surface 312 of the cylindrical shell 310 may include a mechanical treatment and/or a chemical treatment to facilitate adhering an elastomeric material to the inner surface 312 of the cylindrical shell 310 and increase a bond or adhesion strength between the elastomeric material and the inner surface 312 of the cylindrical shell 310. As such, the treatment may extend to only a portion of the inner surface 312 of the cylindrical shell 310, as desired, or may include substantially the entirety of the inner surface 312 of the cylindrical shell 310. In one or more embodiments, the mechanical treatment may include a thermal spray treatment, a laser beam treatment, a plasma coating treatment, and/or a machining treatment, and the chemical treatment may include an etching treatment and/or a primer and adhesive treatment. The total thickness of the adhesive treatment layer may vary, such as from about 10 microns to about 1 mm (about $3.94\times10^{-4}$ in to about $3.94\times10^{-2}$ in), depending on the type and/or amount of treatment used.

For example, a thermal spray treatment and/or a plasma coating treatment may refer to a group of treatments in which metallic, ceramic, tungsten carbide, cermet, and/or some polymeric materials in the form of powder, wire, and/or rod are fed to a torch or gun. The materials are then heated to near or somewhat above the respective melting point. The resulting molten or nearly molten droplets of material are accelerated in a gas stream and projected against the surface to be coated, which in the present case would include the inner surface 312 of the cylindrical shell 310. On impact, the droplets flow into thin lamellar particles adhering to the surface, overlapping, and interlocking as until solidification, thereby resulting in an adhesive treatment layer on the inner surface 312 of the cylindrical shell 310. The total thickness of the adhesive treatment layer may vary, depending on the number of passes from a coating device. U.S. patent application Ser. No. 13/224,642, which is assigned to the assignee of the present disclosure, describes methods of using plasma treatment when forming and/or manufacturing directional drilling assemblies in accordance with the present disclosure.

As mentioned above, another type of treatment in accordance with the present disclosure may include a machining treatment. In accordance with one or more embodiments disclosed herein, a machining treatment may include a treatment in which protrusions and/or pores or voids are formed on the inner surface 312 of the cylindrical shell 310. For example, one or more protrusions, one or more hooks, one or more voids, one or more holes, one or more craters, one or more pinholes, one or more needles, and/or otherwise one or more patterns may be used to form the adhesive treatment layer on the inner surface 312 of the cylindrical shell 310. As such, the adhesive treatment layer may facilitate adhering an elastomeric material to the inner surface 312 of the cylindrical shell 310, such as increasing a bond or adhesion strength between the elastomeric material and the inner surface 312 of the cylindrical shell 310.

Figure 3:
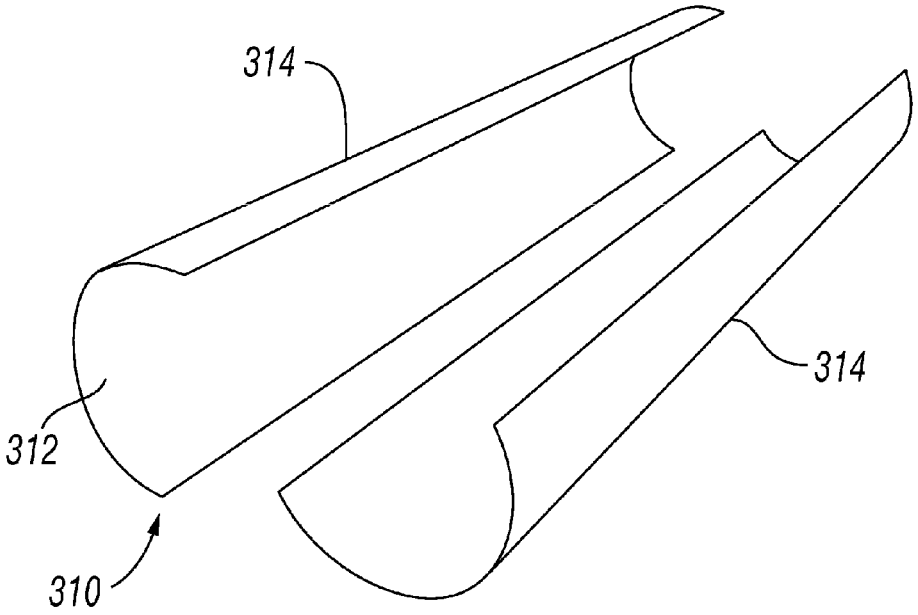
FIG. 3 shows a perspective view of a cylindrical shell of a stator in accordance with one or more embodiments disclosed herein.

Referring still to FIG. 3, the cylindrical shell 310 may be formed using any method known in the art. For example, the cylindrical shell 310 may be formed from a tube already provided, in which the tube may be machined to a desired thickness. The cylindrical shell 310 may be formed by using a metal sheet (e.g., sheet metal), in which the metal sheet may then be rolled, such as by a brake machine, into a desired shape. Alternatively, the cylindrical shell 310 may be formed from extrusion, such as by helical extrusion on a rotary swaging machine. Accordingly, the present disclosure is not so limited in a particular method of how to form a cylindrical shell, as the present disclosure contemplates multiple different methods that may be used in accordance herewith.

The treatment discussed above may be applied to the inner surface 312 of the cylindrical shell 310 either before and/or after the cylindrical shell 310 has been formed. For example, in an embodiment in which the cylindrical shell 310 is formed by rolling sheet metal, the treatment may be applied to the sheet metal before rolled to form the cylindrical shell 310, and/or the treatment may be applied after the sheet metal has been rolled to form the cylindrical shell 310. In an embodiment in which the treatment is applied after the cylindrical shell 310 has been formed, one or more portions from the cylindrical shell 310 may need to be removed to facilitate treatment of the inner surface 312 of the cylindrical shell 310.

For example, as shown in FIG. 3, the cylindrical shell 310 may be split into multiple portions 314, such as halves as shown, to facilitate and provide easier access to the inner surface 312 of the cylindrical shell 310. After the cylindrical shell 310 has been split into multiple portions 314, the inner surface 312 of the multiple portions 314 may be treated, and the portions 314 may be joined back together to form the cylindrical shell 310. For example, the portions 314 may be joined back together, such as by welding, in which the welding seam may be machined to a specific thickness, if desired. Accordingly, the present disclosure contemplates multiple different methods that may be used to form and apply a treatment to an inner surface of a cylindrical shell in accordance herewith.

Figure 2:
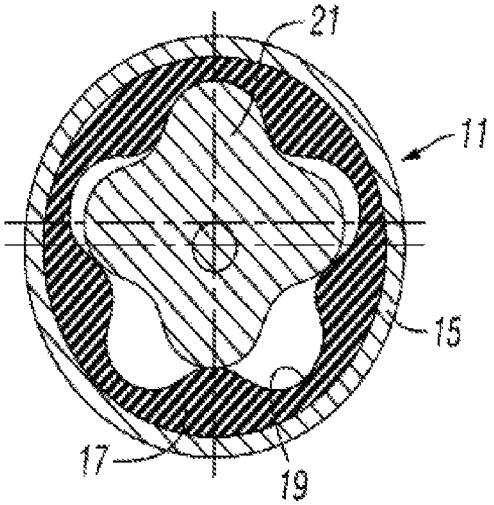
FIG. 2 PRIOR ART
FIG. 2 shows a cross-sectional view of a progressive cavity mud motor.
Figure 4:
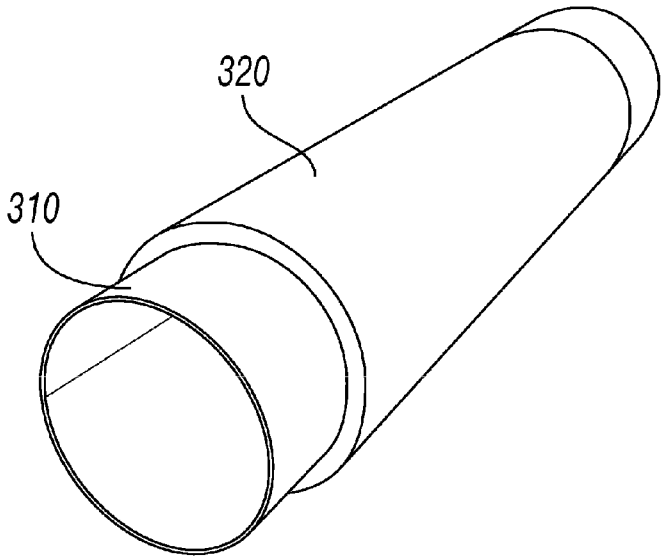
FIG. 4 shows a perspective view of a cylindrical shell disposed within a cylindrical housing in accordance with one or more embodiments disclosed herein.
Figure 5:
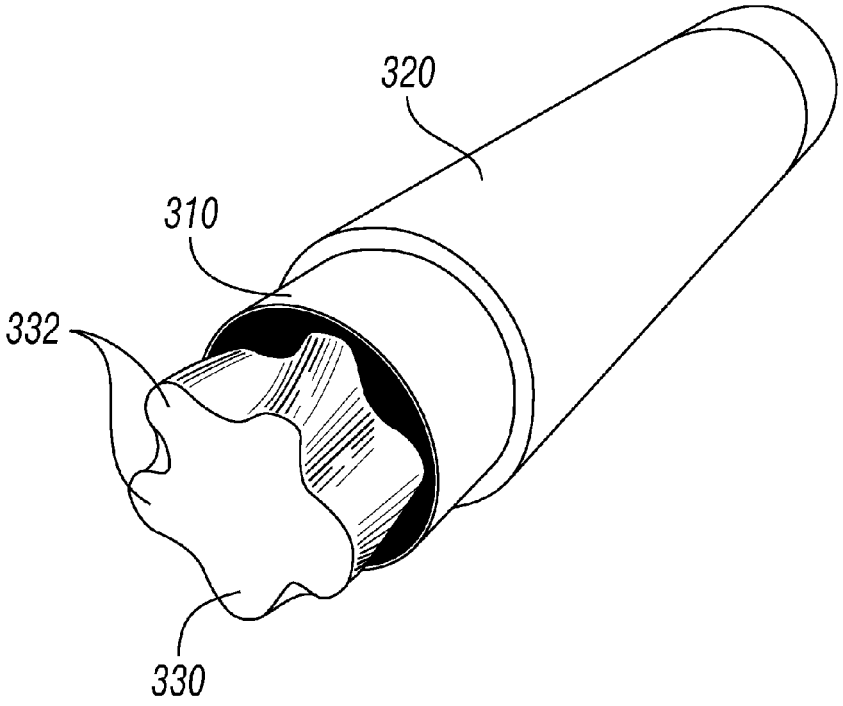
FIG. 5 shows a perspective view of a stator mold and a cylindrical shell disposed within a cylindrical housing in accordance with one or more embodiments disclosed herein.

As shown in FIG. 4, the cylindrical shell 310 may be disposed within a cylindrical housing 320, such as following treatment of the inner surface 312 of the cylindrical shell 310. Further, as shown in FIG. 5, a stator mold 330 may be disposed within the cylindrical shell 310 and the cylindrical housing 320. The stator mold 330 may be used to define and form a stator profile within an elastomeric material disposed between the cylindrical shell 310 and the stator mold 330. As such, the stator mold 330 may include one or more protrusions 332 formed thereon, such as to form cavities (shown as element 19 in FIGS. 1 and 2) within the stator profile of the elastomeric material.

Figure 6:
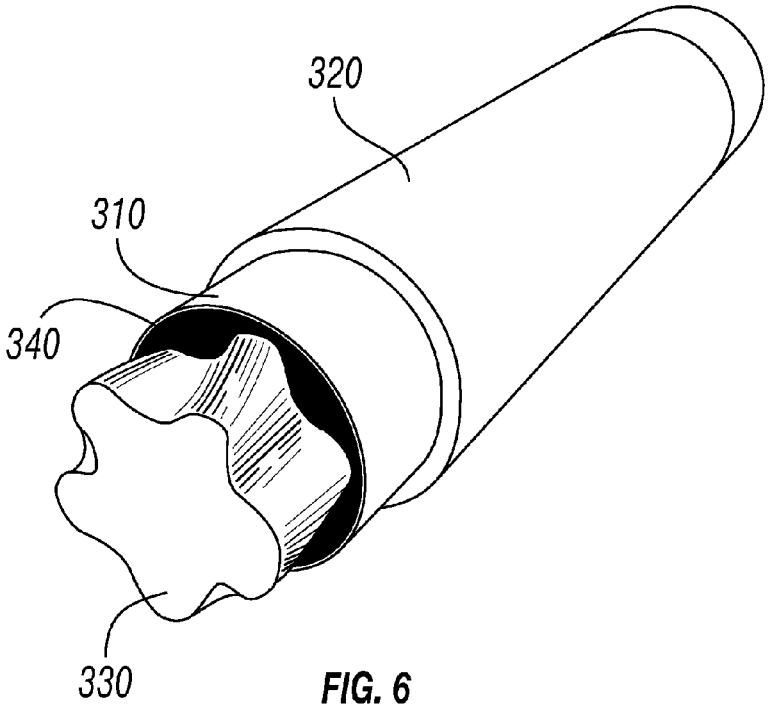
FIG. 6 shows a perspective view of an elastomeric material disposed between a stator mold and a cylindrical shell in accordance with one or more embodiments disclosed herein.

Referring now to FIG. 6, after the stator mold 330 has been disposed within the cylindrical shell 310, an elastomeric material 340 may be disposed between the stator mold 330 and the cylindrical shell 310. For example, the elastomeric material 340 may be injected between the stator mold 330 and the cylindrical shell 310, such as by using a horizontal high pressure injection. The elastomeric material 340 may be any elastomeric material known in the art, such as rubber, used within a stator of a progressive cavity motor or pump. Further, the elastomeric material 340 may include other agents and/or materials, such as fiber, to provide additional desired properties for a stator of a progressive cavity motor or pump. The elastomeric material 340 may then be cured within the cylindrical shell 310 and the elastomeric material 340 may adhere to the inner surface 312 of the cylindrical shell 310. In particular, the elastomeric material 340 may adhere to the adhesive treatment layer formed upon the inner surface 312 of the cylindrical shell 310, thereby facilitating the adhesion and bond between the elastomeric material 340 and the cylindrical shell 310.

Figure 7:
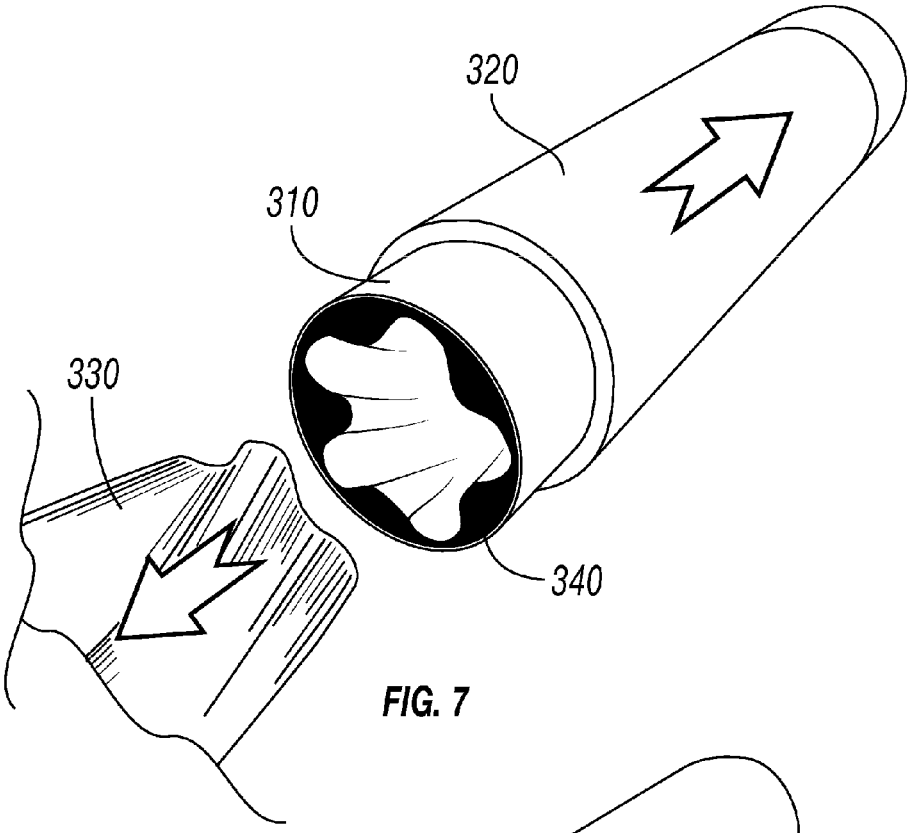
FIG. 7 shows a perspective view of a cartridge having a stator mold removed therefrom with the cartridge removed from a cylindrical housing in accordance with one or more embodiments disclosed herein.
Figure 8:
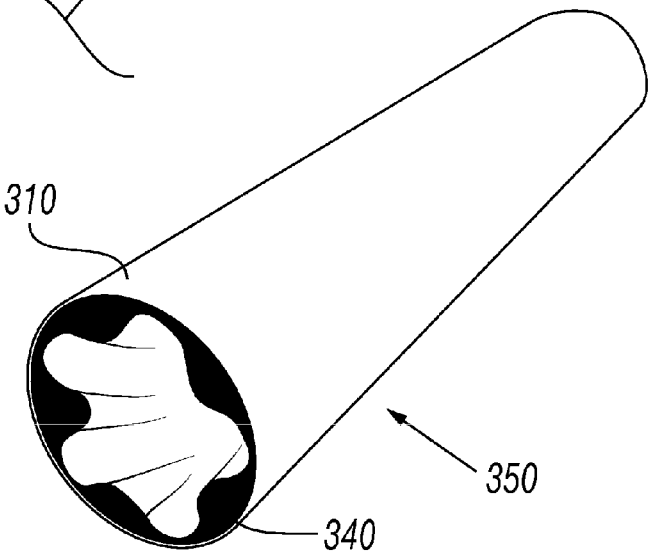
FIG. 8 shows a perspective view of a cartridge of a stator in accordance with one or more embodiments disclosed herein.

Referring now to FIG. 7, following having the elastomeric material 340 disposed within the cylindrical shell 310, the stator mold 330 may be removed from within the elastomeric material 340, thereby forming an elastomeric material layer having a stator profile within the cylindrical shell 310. Further, as also shown in FIG. 7, the cylindrical shell 310 may be removed from within the cylindrical housing 320. Then, as shown in FIG. 8, upon removal of the stator mold 330 from within the elastomeric material 340 and removal of the cylindrical shell 310 from within the cylindrical housing 320, a cartridge 350 may be formed having the elastomeric material layer of the elastomeric material 340 disposed within the cylindrical shell 310.

Figure 9:
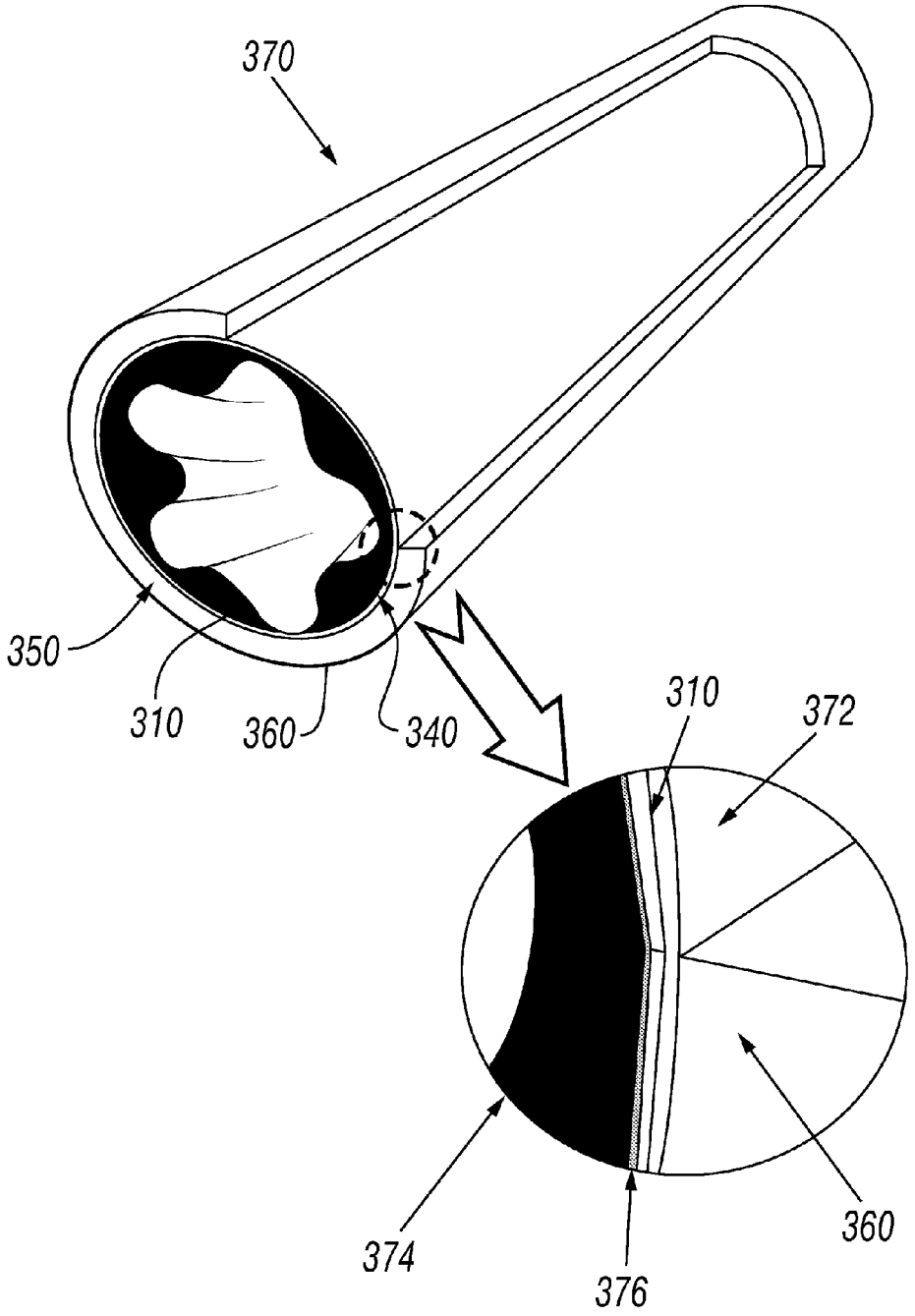
FIG. 9 shows a perspective view of a stator in accordance with one or more embodiments disclosed herein.

Referring now to FIG. 9, upon formation of the cartridge 350, the cartridge 350 may be disposed within a stator housing 360. In particular, the cartridge 350 may be received within the stator housing 360 to form a stator 370, such as that of a progressive cavity motor or pump. An adhesive material may be used to adhere the cartridge 350, and in particular the cylindrical shell 310, to the inner surface of the stator housing 360. As such, an adhesive layer may be disposed on the inner surface of the stator housing 360 and/or on the outer surface of the cylindrical shell 310, thereby forming an adhesive layer between the inner surface of the stator housing 360 and the outer surface of the cylindrical shell 310. The adhesive material may include a metal-to-metal bonding agent, such as to facilitate adhering a metal cylindrical shell to a metal stator housing. Additionally, or alternatively, the adhesive material may include a glue, epoxy, and/or any other material known in the art for adhering purposes.

Accordingly, as shown in the detailed image in FIG. 9, the stator 370 may include the stator housing 360 as an outermost layer, and may include the cylindrical shell 310 disposed within the stator housing 360 with an adhesive layer 372 between the cylindrical shell 310 and the stator housing 360. Further, the stator 370 may include an elastomeric material layer 374 having a stator profile defined therein disposed within the cylindrical shell 310 with an adhesive treatment layer 376 between the elastomeric material layer 374 and the cylindrical shell 310.

An apparatus and method in accordance with one or more embodiments of the present disclosure may be helpful in multiple areas, such as within the oil and gas industry. For example, embodiments disclosed herein may be used to form or manufacture a stator for a progressive cavity motor or pump. Further, embodiments disclosed herein may be used to form or manufacture a cartridge for use within a stator housing of a stator. A cartridge may be used within the present disclosure to facilitate adhering an elastomeric material to a cylindrical shell, and facilitate adhering the cylindrical shell to a stator housing. By using these multiple layers and materials, the adhesion and bonding strength between the layers of the cartridge and the stator may be increased.

Although only a few example embodiments have been described in detail above, those skilled in the art will readily appreciate that many modifications are possible in the example embodiments without materially departing from a method and apparatus to manufacture progressive cavity motors or pumps as described herein. Accordingly, all such modifications are intended to be included within the scope of this disclosure. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke means plus function treatment for any limitations of any of the claims herein, except for those in which the claim expressly uses the words 'means for' together with an associated function.

What is claimed is:

1. A method of manufacturing at least a portion of a progressive cavity motor or pump, the method comprising:
- disposing a cylindrical shell within a cylindrical housing;
- treating at least a portion of an inner surface of the cylindrical shell to promote adhesion of an elastomeric material thereto;
- disposing a stator mold within the cylindrical shell;
- disposing the elastomeric material between the stator mold and the cylindrical shell;
- adhering the elastomeric material to the inner surface of the cylindrical shell;
- removing the stator mold from within the elastomeric material, thereby forming an elastomeric material layer having a stator profile within the cylindrical shell; and
- removing the cylindrical shell from within the cylindrical housing, thereby forming a cartridge having the elastomeric material layer disposed within the cylindrical shell.

2. The method of claim 1, further comprising:
- disposing the cartridge within a stator housing, thereby forming a stator of the progressive cavity motor or pump.

3. The method of claim 2, wherein disposing the cartridge within the stator housing comprises:
- disposing an adhesive material within the stator housing, thereby forming an adhesive layer within the stator housing; and
- adhering the cartridge within the stator housing.

4. The method of claim 3, wherein the adhesive material comprises a metal-to-metal bonding agent.

5. The method of claim 1, wherein disposing the elastomeric material between the stator mold and the cylindrical shell comprises:
- injecting the elastomeric material between the stator mold and the cylindrical shell; and
- curing the elastomeric material.

6. The method of claim 1, wherein treating the inner surface of the cylindrical shell comprises treating at least a portion of the inner surface of the cylindrical shell using a mechanical treatment.

7. The method of claim 6, wherein the mechanical treatment comprises one of a thermal spray treatment, a laser beam treatment, a plasma coating treatment, or a machining treatment.

8. The method of claim 1, wherein treating at least a portion of the inner surface of the cylindrical shell comprises:
- removing a portion from the cylindrical shell;
- treating the inner surface of the cylindrical shell to facilitate adhering the elastomeric material to the cylindrical shell, thereby forming an adhesive treatment layer between the elastomeric material layer and the cylindrical shell; and
- reattaching the portion to the cylindrical shell;
- wherein the disposing the elastomeric material between the stator mold and the cylindrical shell comprises:
  - injecting the elastomeric material between the stator mold and the cylindrical shell;
  - curing the elastomeric material; and
  - adhering the elastomeric material to the cylindrical shell.

9. The method of claim 1, further comprising:
- treating an inner surface of a metal sheet to facilitate adhering the elastomeric material to the inner surface of a metal sheet, thereby forming an adhesive treatment layer on the inner surface of the metal sheet;
- forming the metal sheet into the cylindrical shell.

10. The method of claim 1, wherein treating the inner surface of the cylindrical shell comprises treating at least a portion of the inner surface of the cylindrical shell using a chemical treatment.

11. The method of claim 10, wherein the chemical treatment comprises one of an etching treatment or a primer and adhesive treatment.

12. A stator, comprising:
- a stator housing defining an inside diameter surface;
- a cylindrical shell disposed within the stator housing, the cylindrical shell defining an inner cylindrical surface and an outer cylindrical surface, the outer cylindrical surface being coupled to the inside diameter surface of the stator housing;
- an elastomeric material layer disposed within the cylindrical shell, the elastomeric material layer defining a stator profile within the cylindrical shell and the outer cylindrical surface,
- wherein the inner cylindrical surface of the cylindrical shell is adhered to the outer cylindrical surface of the elastomeric material layer; and
- an adhesive layer on the inner surface of the cylindrical shell, wherein the adhesive layer adheres the cylindrical shell to the elastomeric material layer, and
- wherein the cylindrical shell comprises an adhesive treatment layer on the inner cylindrical surface thereof that promotes adhering the elastomeric material layer to the cylindrical shell.

13. The stator of claim 12, further comprising:

an adhesive layer that couples together the cylindrical shell and the stator housing.

14. The stator of claim 12, wherein the adhesive layer that couples together the cylindrical shell and the stator housing comprises a metal-to-metal bonding agent.

15. The stator of claim 12, wherein the adhesive treatment layer comprises a mechanical treatment area.

16. The stator of claim 15, wherein the mechanical treatment area comprises one of a thermal spray material, a laser beam treated area, a plasma coating, or a machine-treated area.

17. The stator of claim 12, wherein the cylindrical shell comprises two or more portions attached to each other.

18. The stator of claim 12, wherein the adhesive treatment layer comprises one or more hooks, one or more voids, one or more holes, one or more craters, one or more pinholes, one or more needles, or a combination thereof, formed in the cylindrical shell.

19. The stator of claim 12, wherein adhesive treatment layer comprises a chemical treatment area.

20. The stator of claim 19, wherein the chemical treatment area comprises one or an etching or a primer.

21. A method of manufacturing at least a portion of a progressive cavity motor or pump, the method comprising:

treating an inner surface of a cylindrical shell to facilitate adhering an elastomeric material to the cylindrical shell, thereby forming an adhesive treatment layer on the inner surface of the cylindrical shell;

disposing the cylindrical shell within a cylindrical housing;

disposing a stator mold within the cylindrical shell;

injecting the elastomeric material between the stator mold and the cylindrical shell;

curing the elastomeric material;

adhering the elastomeric material to the cylindrical shell;

removing the stator mold from within the elastomeric material, thereby forming an elastomeric material layer having a stator profile within the cylindrical shell;

removing the cylindrical shell from within the cylindrical housing, thereby forming a cartridge having the elastomeric material layer disposed within the cylindrical shell;

disposing an adhesive material comprising a metal-to-metal bonding agent within a stator housing, thereby forming an adhesive layer within the stator housing; and adhering the cylindrical shell within the stator housing, so as to secure the cartridge within the stator housing.

22. The method of claim 21, wherein the treating the inner surface of the cylindrical shell comprises at least one of a mechanical treatment or a chemical treatment.

23. The method of claim 22, wherein the mechanical treatment comprises one of a thermal spray treatment, a laser beam treatment, a plasma coating treatment, or a machining treatment, and wherein the chemical treatment comprises one of an etching treatment or a primer and adhesive treatment.

* * * * *